US006945196B1

(12) United States Patent
Hubert et al.

(10) Patent No.: US 6,945,196 B1
(45) Date of Patent: Sep. 20, 2005

(54) GAS-FIRED WATER HEATER

(75) Inventors: Stefan Hubert, Engelstadt (DE); Oliver Forberich, Steinbach (DE); Alexander Groehl, Dolgesheim (DE); Klaas Roelfsema, Gasselternijveeschemond (NL); Rainer Neubauer, Mainz (DE)

(73) Assignee: Schott Spezialglas AG, Mainz (DE)

( * ) Notice: Subject to any disclaimer, the term of this patent is extended or adjusted under 35 U.S.C. 154(b) by 0 days.

(21) Appl. No.: 10/865,728

(22) Filed: Jun. 10, 2004

(30) Foreign Application Priority Data

May 20, 2004 (DE) ..... 10 2004 025 223

(51) Int. Cl.[7] ..... F22B 5/04
(52) U.S. Cl. ..... 122/14.31; 122/14.2
(58) Field of Search ..... 122/14.31, 13.01, 122/14.2

(56) References Cited

U.S. PATENT DOCUMENTS 4,953,510 A 9/1990 Akkala et al.
5,355,841 A * 10/1994 Moore et al. ..... 122/18.31
5,875,739 A * 3/1999 Joyce ..... 122/18.31
5,915,954 A * 6/1999 Rodgers ..... 431/329
6,725,811 B1 * 4/2004 Moore et al. ..... 122/13.01
2003/0111023 A1 6/2003 Carbone et al.

* cited by examiner

*Primary Examiner*—Gregory Wilson
(74) *Attorney, Agent, or Firm*—Michael J. Striker

(57) ABSTRACT

The water heater has an upright water tank (1), an exhaust flue (3) extending through the water tank, a combustion chamber (2) arranged under the water tank, an atmospheric gas burner (5) in the combustion chamber and a complete pre-mixing gas/air supply system with outside gas and air intakes. The gas burner has a burner mat (7) with a pressure drop less than 5 to up to 45 Pa. The combustion chamber (2) is provided with an opening (2*b*), which is not sealed, but enclosed in a flame-blocking manner. The gas burner (5) is attached to a wall section (2*a*), which is mounted releasably on the: combustion chamber wall (W) over opening (2*b*) so that a gap of predetermined width is formed between the wall section and wall (W), which prevents backfire of flames into the surroundings but admits secondary air.

7 Claims, 3 Drawing Sheets

GAS-FIRED WATER HEATER

BACKGROUND OF THE INVENTION

1. Field of the Invention

The present invention relates to a gas-fired water heater, comprising an upright thermally insulated cylindrical water tank, a central exhaust flue extending axially through the water tank and a combustion chamber arranged under the exhaust flue, which has an atmospheric gas burner in it. The atmospheric gas burner has a flat burner mat and a complete pre-mixing gas/air supply system with a combustion-gas-single-barreled combustion gas nozzle, which has an intake for the combustion gas and combustion air arranged outside of the combustion chamber.

2. Description of the Related Art

Gas-fired water heaters are marketed in many different embodiments for different applications. They serve especially for supplying hot water in homes or houses. The so-called boiler for supplying hot water is a typical unit of this sort.

The present invention relates to a special, gas-fired water heater, the so-called "water heater", as is typically extensively used in households, work places and small industrial plants, as a free-standing hot water reservoir for hot water supply, for example, for taking showers.

This "water heater" has a typical structure, as described for example in U.S. Pat. No. A 4,953,510. The central component of the water heater is a longitudinally extending cylindrical reservoir tank for storing the heated water, through which a central exhaust flue extends and which is free-standing on the ground or floor by means of feet.

An open atmospheric gas burner with suitable power is arranged under the reservoir tank, whose lower wall is cup-shaped. This atmospheric gas burner causes hot exhaust gas including combustion products to rise and flow against the bottom of the water tank and subsequently through the long exhaust gas flue. In this type of water heater the hot gas flowing upward in the exhaust gas flue contacts the inner surfaces of the flue pipe, while the water in the reservoir tank is in contact with the outer surfaces of the flue pipe. During the combustion process the water inside the reservoir tank is heated by heat conduction through the wall of the exhaust flue. In this type of water heater normally a long separating wall is arranged within the exhaust gas pipe in order to improve the efficiency of the heat transfer from the hot combustion gases through the wall of the exhaust flue to the water within the reservoir tank. Furthermore this sort of water heater can have a thermally activated valve, which halts combustion by the gas burner, when the temperature of the water inside the reservoir reaches a predetermined temperature. In order to reduce the heat losses from the water heater during heating of the water and also after halting the combustion process, the exterior surfaces of the reservoir tank are typically covered with a heat insulating material.

There has been increasing strengthening of legislation regarding avoiding accidents, caused when inflammable vapors rise into the open combustion region, and increasing improvements in exhaust gas evaluation. This has led to development of water heaters a, which do not have an open combustion arrangement but instead have a closed combustion chamber, in which a completely pre-mixing gas burner, a so-called pre-mix burner, is arranged.

This sort of water heater is described in U.S. Pat. No. 5,875,739. The structure and arrangement of the pre-mix burner in the closed combustion chamber is shown in FIG. 3 of the present application, which is taken from the aforementioned U.S. Patent. This cross-sectional view shows a water heater with a water tank 1 and a closed combustion chamber 2, to which an exhaust flue 3 is connected, which extends centrally through the water tank 1. Combustion chamber 2 and water tank 1 are thermally insulated from the surroundings by thermal insulation 4. An atmospheric pre-mix burner 5 is arranged in the combustion chamber 2. The atmospheric pre-mix burner comprises a mixing chamber 6 and a spherical combustion surface 7. A Venturi-pipe 8 is connected to the mixing chamber 6, which extends through the thermal insulation 4 to the outer surfaces of the water heater. A gas nozzle 10 for supplying combustion gas is arranged within the outer opening 9 of the Venturi-pipe 8. When combustion gas flows into the Venturi-pipe 8 through the gas nozzle 10, primary air is drawn in through the outer opening 9 because of the flow action properties of this pipe, which is then mixed with the combustion gas by turbulence in the mixing chamber 6.

Another embodiment of a water heater with a complete pre-mixing atmospheric gas burner is described in U.S. Published Patent Application U.S. 2003/0111 023 A1. The gas burner 5 described in this reference has a plane rectangular burner mat 7, as shown in FIG. 4 of the present application, which is taken from the aforementioned U.S. Patent Application. This figure shows the mixing chamber 6 with the molded Venturi-pipe 8 including the feed 10 of combustion gas and the feeds 9 of primary air.

In both references water heaters with combustion chambers, which are completely sealed and kept at low pressure, without a powered mechanical blower or fan, are described. Intake of additional combustion air, also called secondary air, is not possible and undesirable in regard to maintaining exhaust gas quality, because the combustion chamber is sealed from the surroundings. If additional combustion air could flow in, the required low values of CO and NOx concentration could not be attained. However sealing the combustion chamber from the surrounding air is only accomplished with extra effort and is not economical.

The closed, completely sealed combustion chamber makes servicing and maintenance, and also construction, of the gas burner difficult. The comparatively heavy reservoir tank must be separated from the combustion chamber in order to gain access to the gas burner in the combustion chamber, which is possible only with the help of a block and tackle or hoist or some other lifting tool. Also the combustion chamber must be tightly sealed again during re-assembly.

SUMMARY OF THE INVENTION

It is an object of the present invention to provide a gas-fired water heater of the U.S.—water-heater type with a combustion chamber, which is constructed so that the gas burner can be rapidly and easily assembled, disassembled or exchanged during repair and maintenance procedures.

It is also an object of the present invention to provide a gas-fired water heater of the U.S.—water-heater type with a combustion chamber, which is constructed so that the required legally established exhaust gas limiting concentrations are attained now and also in the future, when even lower concentrations are required.

This object and others, which will be made more apparent hereinafter, are attained in a water heater, comprising an upright thermally insulated cylindrical water tank, an exhaust flue extending axially and centrally through the water tank, a combustion chamber arranged under the exhaust flue, which has an atmospheric gas burner in it, which has a burner mat providing a combustion surface, and a complete pre-mixing gas/air supply system, which has intakes for combustion gas and combustion air arranged outside of the combustion chamber.

According to the present invention an opening is provided in the wall of the combustion chamber, which is not sealed, but enclosed in a flame-blocking manner, a sufficiently large wall section is attached to the gas burner and closure elements for releasable mounting of the wall section of the gas burner on the wall of the combustion chamber are provided, so that the burner can be mounted in a flame-blocking manner in the opening provided in the wall of the combustion chamber.

By the use of a burner mat with an outstandingly low pressure drop in a range of less than 5 Pa up to 45 Pa, according to the specific load ($W/cm^2$) and perforations, sealing the combustion chamber from the environment is not necessary. The legally required low exhaust gas concentration for CO and NOx can be attained without sealing the combustion chamber in contrast to the state of the art because of the greatly reduced pressure drop. This has the advantage that the low exhaust gas concentrations in contrast to the state of the art are maintained even at higher operating loads, for example 40,000 BTU, 50,000 BTU and 60,000 BTU (British Thermal Units).

It is especially significant that the low pressure drop is maintained, even with a small burner surface area.

A very strong draw through the burner is obtained, which is similar to that in a chimney, because of the use of the burner material with an outstandingly low pressure drop, that is with a very low counter pressure in operation. So much primary air is drawn in because of that that the required low NOx values are attained in each case, independently of whether or not the combustion chamber is sealed. Furthermore this strong draw also guarantees a tendency for backfire of flames through the burner material into the mixing chamber, a so-called "flash back".

Secondary air can flow in from the surroundings because the combustion chamber is not sealed, since the combustion chamber does not need to be tightly enclosed to obtain the required exhaust gas concentration values. In order to prevent a backfire of the flames into the surroundings because of the lack of a sealing, which is required by the above-described legislation, it is necessary to provide an arrangement so that the secondary air flows in through a so-called flame arrester or flame blocking means. This flame arrester can be provided, for example by a definite gap width at the entrance opening to the combustion chamber, through which the flames cannot flash back.

In addition the burner itself protects from a backfire of flames through the burner material into the combustion chamber, the so-called "flash back". The quasi-flash-back protection is provided at low burner capacity by the lower pressure loss and the resulting great draw.

The elimination of expensive sealing of the combustion chamber makes a simplified burner construction, a sort of door structure for the burner, possible. The gas burner of the invention is insertable like a drawer into the combustion chamber and is releasably attached to the wall of the combustion chamber without sealing means. Because of that the entire gas burner can be disassembled rapidly for maintenance and the burner mat itself likewise, according to its structure, can be rapidly and easily exchanged. Also the problem of flame blocking or arresting is solved by means of this door structure. The gap between the door and the wall of the combustion chamber should be definitely constructed so that the flames cannot backfire. This can be achieved e.g. with suitable stamped nubs, knobs or burls.

Various embodiments of the invention are described in the appended dependent claim and also in the following description with the help of the figures.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
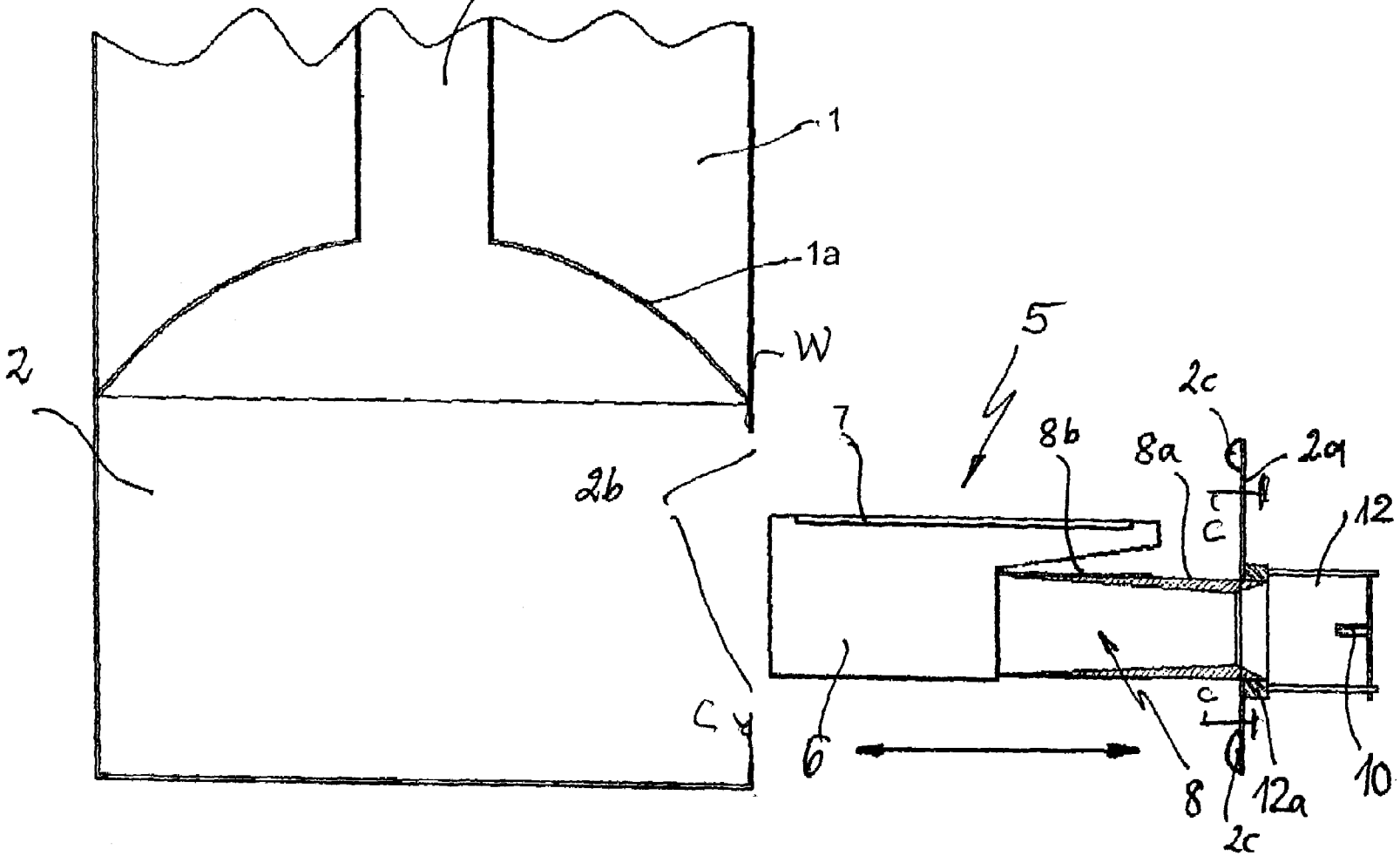
FIG. 1 a schematic cross-sectional view showing the basic structure of a gas-fired water heater according to the invention with a gas burner, which is insertable like a drawer in the combustion chamber of the water heater.

FIG. 1 shows a basic structure of the water heater according to the invention comprising a water tank 1, an exhaust gas flue 3 passing centrally through the water tank 1 and a curved cup-shaped lower wall 1*a*, under which the compartment-like combustion chamber 2 is located.

These parts of the structure of the water heater are known and needs no further detailed description.

In contrast to the known structure the complete pre-mix burner 5 is not "so-to-speak" stationary within a completely sealed combustion chamber 2, but it is formed so that it can be pushed into and pulled out from the combustion chamber like a drawer. Also an opening 2*b* is formed in an outer wall W of the combustion chamber, which is closed by a wall section 2*a* mounted or attached to the burner 5 without expensive or difficult sealing elements. The wall section 2*a* has knobs, burls or nubs 2*c*, which provide a gap with a definite gap width (about 0.8 mm) and form a flame-blocking device (flame arrester).

The gas burner 5 is releasably mounted in the combustion chamber 2 with this wall section 2*a*, e.g. by closure elements C, which can be screw connections. Thus it can advantageously be rapidly and easily assembled and disassembled in maintenance and/or repair situations. Otherwise expensive and troublesome sealing features must be taken into consideration during maintenance and/or repair.

Figure 2A:
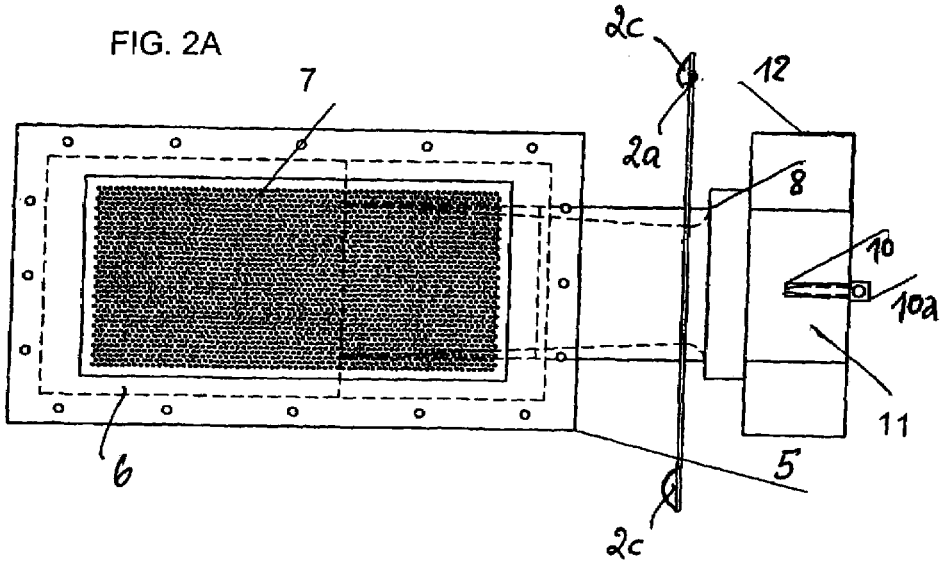
FIGS. 2A and 2B are top plan and side views of an atmospheric gas burner with low pressure drop through the burner mat for the water heater according to FIG. 1, which is associated with a complete pre-mixing Venturi gas/air supply system, wherein a first parallelepiped-shaped embodiment of a oscillation-damping air supply chamber is connected to the intake of the air supply system for combustion air outside of the combustion chamber.
Figure 2B:
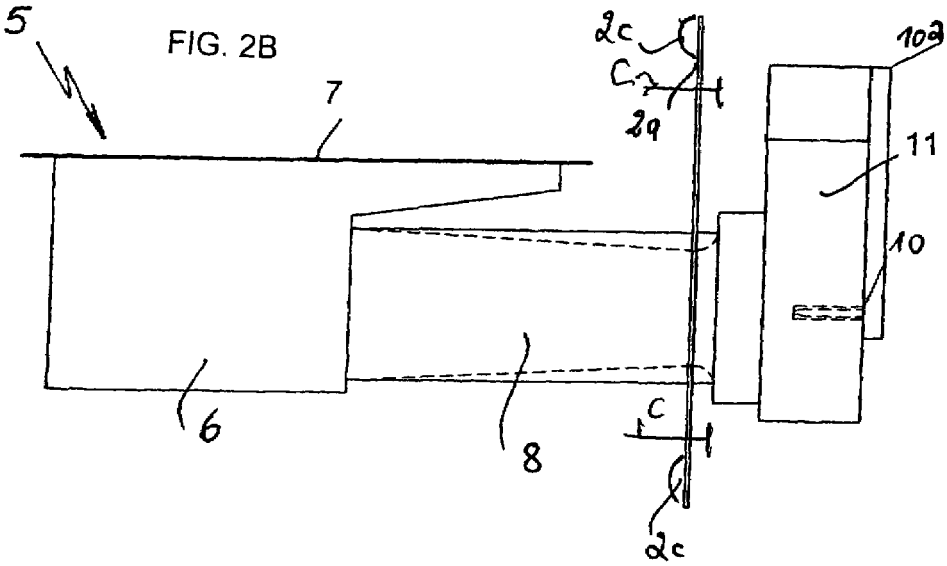
Figure 4:
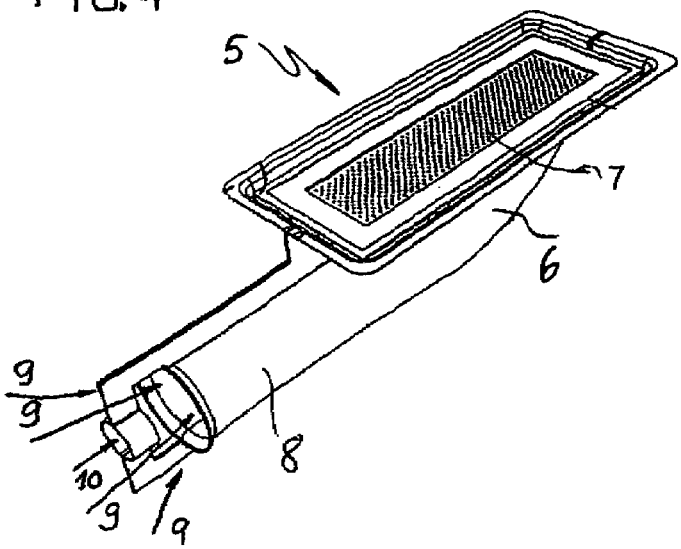
FIG. 4 PRIOR ART
FIG. 4 is a perspective view of another embodiment of a known complete pre-mixing gas burner with a planar burner surface.

The detailed structure of the gas burner 5 is shown in FIGS. 2A and 2B. These figures show an embodiment of the atmospheric gas burner 5, which is formed in a manner similar to the known gas burner shown in FIG. 4. The term "atmospheric gas burner" means a burner, which burns the combustion gas without blower or fan assistance.

The gas burner 5 has, among other features, a planar rectangular, round or free-form burner mat 7, which is a burner mat comprising ceramic fibers, which is known under the trademark CERAMAT® of Schott.

The burner mat 7 covers a mixing chamber 6, to which a Venturi-pipe 8 is molded or connected. The combustion gas is supplied through an intake duct 10*a*, whose lower end opens into a single-barreled combustion gas-nozzle 10, which feeds the combustion gas into the Venturi-tube 8. A parallelepiped chamber 11, which has a lateral air entrance port 12 for combustion air and in which the single-barreled gas nozzle 10 opens, is connected to the air intake opening of the Venturi-tube 8. This combustion air supply chamber 11 has a definite volume, for example 2.5 liters, which attenuates noise arising in resonance in the combustion chamber, so that no troublesome acoustic fluctuations arise and the combustion remains stable. This sort of structure is characterized in acoustics as a Helmholtz resonator.

The air supply chamber 11 shown in FIGS. 2A and 2B is parallelepiped. The air supply chamber 11 connected to the Venturi-pipe 8 can also have other shapes. For example it can be a channel-like air supply chamber 11 partially covering the combustion chamber wall W, extending on both side of the single-barreled gas nozzle 10 with a rectangular cross-section and with air entrance openings on both sides.

The gas burner 5 shown in FIG. 1 corresponds principally to that shown in FIGS. 2A and 2B, with the exception of the above-described Helmholtz resonator. The combustion gas nozzle 10 is attached to a nozzle holder 12, which is attached by means of a metal ring 12*a* to a Venturi insert 8*a*, which similarly is made of metal and is inserted in metal pipe 8*b*.

The Venturi-pipe 8 in the figures is formed as a mixing pipe. Other known configurations, especially mixing pipes, can be provided as a mixing device.

Figure 3:
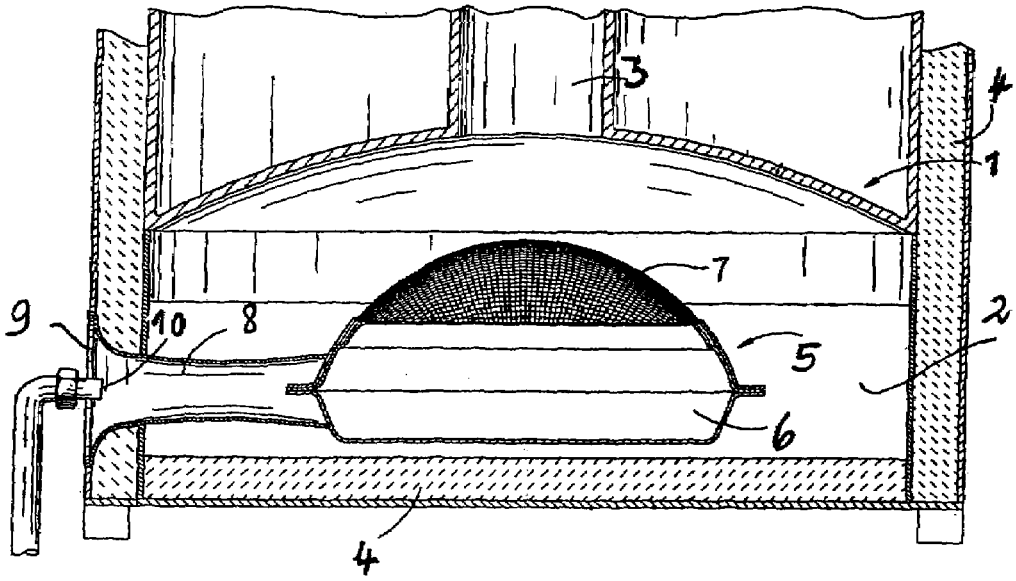
FIG. 3 PRIOR ART
FIG. 3 is a cutaway longitudinal cross-sectional view through a water heater of the prior art, showing a complete pre-mixing gas burner with a spherical burner surface.

Other complete pre-mixing gas burners, for example those having metal fiber, ceramic plates, etc as burner material, can be used instead of the complete pre-mixing gas burner shown in FIGS. 1 to 3.

The burner mat 7 operating as radiant burner in a known manner comprises a so-called matted or tangled fleece of ceramic fibers, which are also coated with silicon carbide and are connected with each other at their contact points in a stable mat structure of a definite porosity. The manufacture of the burner mat used in the gas burner according to the invention is such that in operation a very low pressure drop occurs, which permits elimination of expensive sealing devices for the combustion chamber.

The burner mat used in the water heater according to the invention has the following advantages, which the entire system benefits from:

- high porosity of about 95%, i.e. the gas-air mixture flowing through it can easily penetrate through the entire mat surface and burn there forming a carpet of flames,
- a stable combustion, a wide modulation spectrum and a high power density is provided,
- a compact resulting burner structure,
- low NOx emissioins because of low flame temperatures;
- homogeneous radiation, i.e. the upper surface of the burner mat attains temperature up to 1000° C. in operation and glows up to about 1 mm depth, while the lower side has temperatures under 200° C. Also frequent temperature changes are possible, which permits use also in difficult combustion conditions,
- rapid reaction, i.e. the low thermal inertia leads to very rapid reaction times for the burner in heating up and cooling down;
- low thermal condition, i.e. the very compact burner can be operated safely at high power,
- self-supporting structure, i.e. by coating the ceramic fibers with SiC the burner mat is very stiff, so that the mat supports itself, i.e. expensive holding and supporting structures can be eliminated thus reducing costs,
- low thermal expansion, i.e. the burner mat scarcely changes its shape or size during heating,
- unquestionable in regarding to personal health, i.e. the diameter of the fibers is from 25 to 30 $\mu$m and thus well separated from the health critical range of less than 3 $\mu$m, and
- perforatable according to customer desire.

Because of the structure of the claimed invention the safety and reliability of the gas burner system for the water heater in regard to service life, maintenance freedom and service is increased.

The disclosure in German Patent Application DE 10 2004 025 223.8 of May 20, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a gas-fired water heater, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A water heater comprising an upright thermally insulated cylindrical water tank (1) with a lower wall (1*a*), an exhaust flue (3) extending axially and centrally through the water tank, a combustion chamber (2) arranged under the lower wall (1*a*) and connect to the exhaust flue, an atmospheric gas burner (5) in said combustion chamber and a complete pre-mixing gas/air supply system for the atmospheric gas burner, wherein said atmospheric gas burner comprises a burner mat (7) providing a combustion surface and said gas/air supply system has respective intakes for combustion gas and for combustion air arranged outside of the combustion chamber;

wherein the gas burner (5) is attached to a wall section (2*a*), the combustion chamber (2) has an outer wall (W) provided with an opening (2*b*), said opening (2*b*) being partially closable by said wall section (2*a*) so that a gap of a predetermined width is provided between the wall section (2*a*) and the outer wall (W), and the gas burner (5) is releasably mounted in the combustion chamber (2) with the wall section (2*a*) by means of closure elements (C) that hold the wall section (2*a*) on the outer wall (W) over the opening (2*b*); and wherein the width of the gap is such that secondary air flows into the combustion chamber (2) through the gap but backfire of flames from the combustion chamber to the surroundings is prevented; and wherein said burner mat has a porosity such that a pressure drop across said burner mat (7) is in a pressure range of less than 5 Pa up to 45 Pa.

2. The water heater as defined in claim 1, wherein said complete pre-mixing gas/air supply system comprises a Venturi-pipe (8), a combustion-gas-single-barreled combustion gas nozzle (10) and an associated gas intake duct **(10*a*) integrated with the Venturi-pipe (8)**.

3. The water heater as defined in claim 1, wherein said complete pre-mixing gas/air supply system comprises a Venturi-pipe (8).

4. The water heater as defined in claim 1, wherein said burner mat (7) comprises ceramic fibers coated with silicon carbide.

5. The water heater as defined in claim 4, wherein said burner mat is a Schott CERAMAT® burner mat comprising said ceramic fibers coated with said silicon carbide.

6. The water heater as defined in claim 1, further comprising a nub, burl or knob structure **(2*c*)** arranged to provide said gap with said gap width.

7. The water heater as defined in claim 6, wherein said nub, bud or knob structure is provided on said wall section **(2*a*) attached to said gas burner (5)**.

* * * * *